United States Patent [19]

Spitz

[11] 4,019,211

[45] Apr. 26, 1977

[54] BEDFRAME WITH UNITIZED ADJUSTABLE CROSSBAR

[76] Inventor: Melvin P. Spitz, 619 N. Elm Drive, Beverly Hills, Calif. 90210

[22] Filed: Dec. 16, 1975

[21] Appl. No.: 641,254

[52] U.S. Cl. ..... 5/181; 5/185; 5/202

[51] Int. Cl.[2] ..... A47C 19/04

[58] Field of Search ..... 5/202, 181, 236, 304, 5/174, 185

[56] References Cited

UNITED STATES PATENTS

| | | | |
|---|---|---|---|
| 2,544,274 | 3/1951 | Moeller | 5/185 |
| 3,123,837 | 3/1964 | Paine et al. | 5/181 |
| 3,646,623 | 3/1972 | Harris | 5/181 |
| 3,824,638 | 7/1974 | Bogar | 5/181 |
| 3,871,039 | 3/1975 | Garceau | 5/181 |

*Primary Examiner*—Paul R. Gilliam
*Assistant Examiner*—Andrew M. Calvert
*Attorney, Agent, or Firm*—Whann & McManigal

[57] ABSTRACT

A bedframe having side rails interconnected by end crossbars which are adjustable to provide a plurality of different standard bed widths, each of the crossbars being formed by at least two telescoped sections which are interconnected to provide a unitary crossbar assembly in which the component parts are mechanically retained against disassembly, and wherein the sections are arranged to be latched in selective bed width positions by means of a latch member movably supported on the outermost of the telescoped sections for movement between a raised non-latching position in which a projection on the latch member is freely movable along an adjacent side channel formed in the other of the telescoped members, and a latching position in which the projection is moved into one of a plurality of spaced apart slots in communication with the side channel.

10 Claims, 7 Drawing Figures

BEDFRAME WITH UNITIZED ADJUSTABLE CROSSBAR

PRIOR ART

In the prior art there are a number of bedframe crossbars of the adjustable type which permit adjustment to provide selective bed widths. The closest art known to applicant are the following patents:

U.S. Pat. No. 2,544,274 — Mar. 6, 1951
U.S. Pat. No. 3,100,304 — Aug. 13, 1963
U.S. Pat. No. 3,744,069 — July 10, 1973
U.S. Pat. No. 3,781,930 — Jan. 1, 1974

BACKGROUND OF THE INVENTION

The present invention relates generally to a bedframe construction.

Heretofore, it has been known generally, as exemplified U.S. Pat. No. 2,544,274, to provide a bedframe in which a pair of side rails are interconnected by means of crossbars, and wherein each crossbar may comprise a pair of angle-sections which are hingedly permanently connected at their base ends to the respective side rails so as to be foldable into a compact position extending along the associated rail for shipment, storage, and the like. When the bedframe is assembled, the sections of each crossbar are interconnected with their outer ends in overlapped relation to provide the desired bed width, whereupon the sections are secured in the adjusted position by means of appropriate latching or securing means.

The present invention differs over the prior art concepts in that the crossbar is constructed as a separate completely assembled unit which is releasably connectible at its outermost ends with the respective side rails of the bedframe. The construction is such that the crossbar may be preassembled at the factory and requires no tools for either connecting it with the side rails or for adjusting it to the desired bed width. Moreover, the frame supporting caster assemblies are secured directly to the crossbar to provide an integral part of the unitized crossbar assembly.

SUMMARY OF THE INVENTION

More specifically, the present invention relates to and is concerned with improved connecting means for securing the adjustable parts of the crossbar together and for their manipulation to effect adjustment to the desired bed width.

It is an important object and feature of the present invention to provide a unique adjustable crossbar structure in the form of a unitized assembly with built-in latching mechanism, and which embodies telescoped tubular members, whereby a crossbar of extremely high strength is obtained, and in which twisting distortion will be reduced to a minimum.

A further object is to provide an improved bedframe crossbar of the length ajustable type, which is susceptible of complete assembly at the factory into a unitary structure, which includes a unique latching mechanism which not only functions to retain the crossbar in its adjusted position, but also contributes to the securement of the crossbar components against disassembly into separated parts which could easily be lost or misplaced.

Still another object is to provide an adjustable crossbar unit which is factory assembled, which has not loose or dangling parts that might become lost or misplaced, and which is of compact form for facilitating storage, shipment, and the like, in its completely assembled condition.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENT

Figure 1:
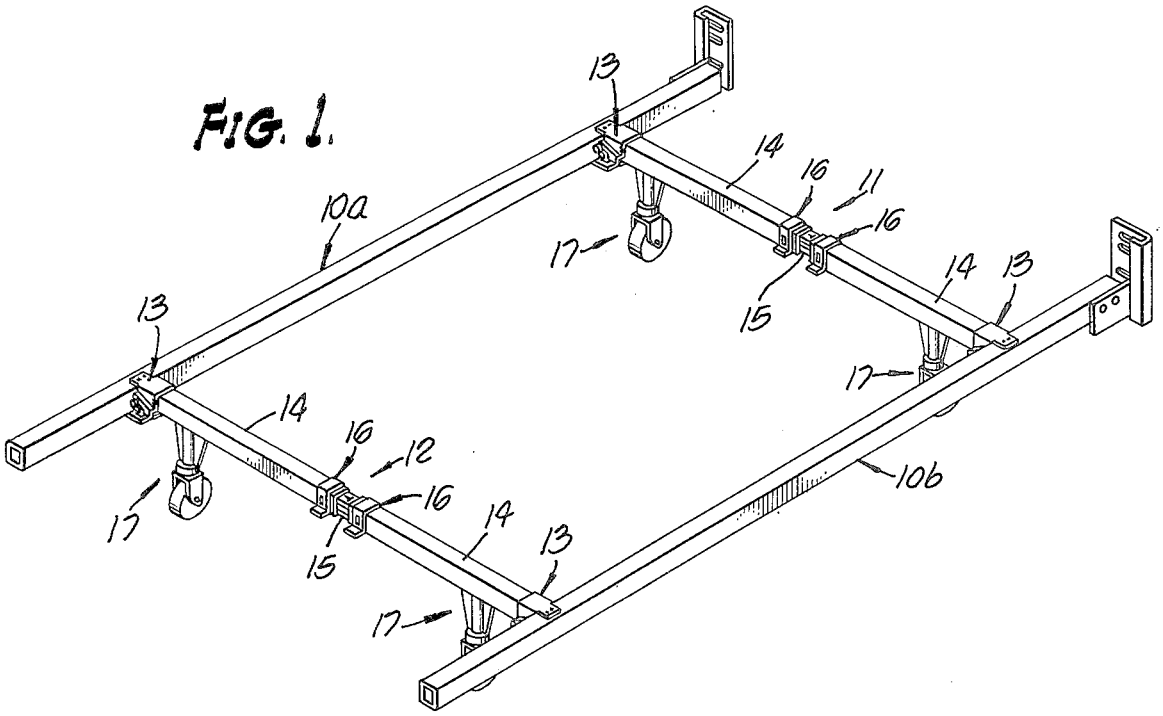
FIG. 1 is a perspective view of a bedframe structure embodying the features of the present invention.

Referring now specifically to the drawings, for illustrative purposes, a bedframe embodying the present invention is disclosed in FIG. 1 as comprising a pair of laterally spaced side rails 10*a* and 10*b*, these rails being interconnected at the head end and foot end of the bedframe structure by crossbar assemblies, as generally indicated by the numerals 11 and 12. Each of the crossbar assemblies is connected at its opposite ends into a releasably latched socket fitting 13 of conventional construction, and well known in the industry.

Each of the crossbar assemblies is similarly constructed and comprises a factory assembled unit which is arranged for selective length adjustment to obtain different bed width frame structures.

Each crossbar assembly is shown as comprising a pair of axially aligned end sections 14 and an intermediate section 15. The three sections are formed of extruded tubular members having a multisided cross-section, and in this case being of rectangular configuration. The sections are assembled with the end sections 14 having adjacently disposed innermost ends which telescopically receive the outer end portions of the intermediate section. The end sections 14 thus comprise the outer members of the telescoped assembly, and the intermediate member 15 is the inner telescoped member. With the sections thus arranged, the end sections 14 may be relatively moved with respect to the intermediate section 15 into salient adjusted positions corresponding to different bed widths, and a latching mechanism including a latch member 16 at the innermost end of each of the end sections is provided for latching and unlatching the sections with respect to each other. A caster assembly 17 is secured to the outer end of each of the end sections 14 at a position inwardly spaced from the end terminus of the section.

Figure 3:
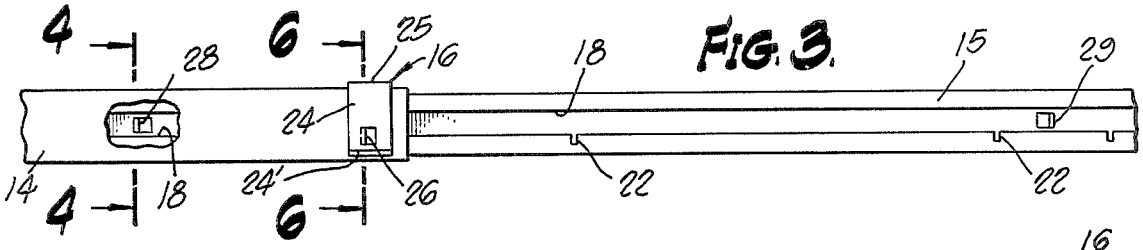
FIG. 3 is an enlarged fragmentary elevational view of the same, and further showing the arrangement of abutment stops to prevent disassembly of the adjustable crossbar sections.
Figure 6:
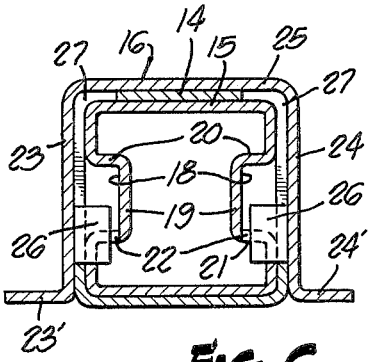
FIG. 6 is an enlarged fragmentary transverse sectional view taken substantially on line 6—6 of FIG. 3, to show details of the latch mechanism, the latch being in latching position.

More specifically, the end sections and intermediate sections are telescoped with their corresponding walls in close fitting sliding relationship. As best shown in FIG. 6, the intermediate section is provided on each of its opposite side walls with a longitudinally extending outwardly opening channel 18 having a back wall 19, a top wall 20 and a bottom wall 21. The bottom wall 21 and adjacent side wall of the intermediate section are cut out to provide a series of longitudinally spaced downwardly extending slots 22, as shown in FIG. 3, which define the ajustable positions of the crossbar for the respective bed widths, as will hereinafter be explained more fully.

A latch member 16 is mounted at the innermost end of each of the end sections 14. The latch member is fabricated from strap material and deformed to provide an inverted U-shape in which leg portions 23 and 24 are interconnected by a bridging portion 25. Each of the leg portions is respectively deformed to provide a right angles outwardly projecting end portion as indicated at 23' and 24', respectively.

Figure 7:
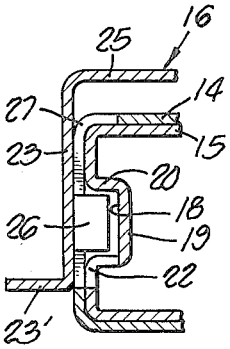
FIG. 7 is a fragmentary section similar to that of FIG. 6, showing the latch member in non-latching position.

Each of the leg portions carries an inwardly struck right angled projection or tongue 26 having a height slightly less than that of the width of the channel 18. The tongue 26 is so positioned on the leg portion that, when the latch member is in its lowered latching position as shown in FIG. 6, the tongue 26 at its lowermost edge margin will extend into a slot 22 and thus retain the crossbar sections 14 and 15 against relative movement at the selected bed width. When the latch member is raised to a non-latching position, as shown in FIG. 7, the projecting tongue 26 will be positioned within the longitudinally extending channel 18, thus enabling adjusting telescoping movements between the edge section 14 and the intermediate section 15 of the crossbar. It will be further noted that in the non-latching position, the projection or tongue 26 at its uppermost end will engage the top wall of the channel 18 to restrain withdrawal of the latch member 16 from its mounted position on the associated end section.

Figure 4:
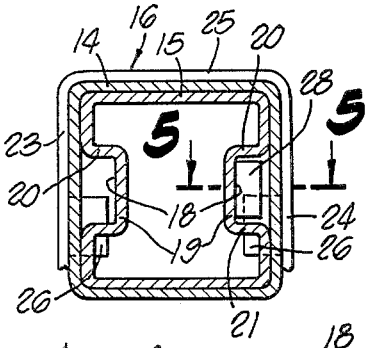
FIG. 4 is a further enlarged transverse sectional view, taken substantially on line 4—4 of FIG. 3 to show further details of the abutment stop and connected relationship of the crossbar sections.
Figure 5:
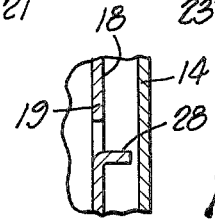
FIG. 5 is a fragmentary sectional view, taken substantially on line 5—5 of FIG. 4, to illustrate the manner in which the abutment stop is formed.

The latch member 16 is arranged to be assembled onto the associated end section 14 during the factory assembly process, and prior to the time that the end sections 14 and intermediate sections are assembled into telescopic relationship. For this purpose, the opposite side walls of the end section and adjacent margins of the top wall thereof are cut out to provide confronting generally inverted L-shaped slots 27 for respectively receiving the tongues 26, when the latch member 16 is placed in a straddling position on the end section, the guided movement of the tongues 26 in the slots 27 enabling downward movement of the latch member toward a seated position. The latach carrying end of the end section is then inserted over an end of the intermediate section, and by raising the latch member until the tongues 26 are positioned within the channels 18, the completion of the telescopic assembly of the two sections may be completed. The connected sections are then moved to their fully retracted telescoped positions, whereupon a suitable tool may be inserted within the outermost end of the end section 14 to bend a struck-out tongue portion 28, as shown in FIGS. 4 and 5, from the bottom wall 19, in a manner to extend at right angles into the channel 18, so as to form a stop abutment with respect to the tongue 26 during its sliding movement in the channel in a direction which would otherwise permit separation of the assembled end and intermediate sections. A similar struck-out tongue 29 in the channel 18 centrally positioned between the section ends serves to limit the inward movements of the end sections.

With the crossbar components factory assembled as described above, there are no loose or separate parts which can become misplaced or lost. Further, the parts cannot readily be disassembled, but may be adjusted for different bed widths by a simple manipulation of the latch member 16, and requires no tools for adjustably arranging the crossbars to provide for different standard bed widths.

Figure 2:
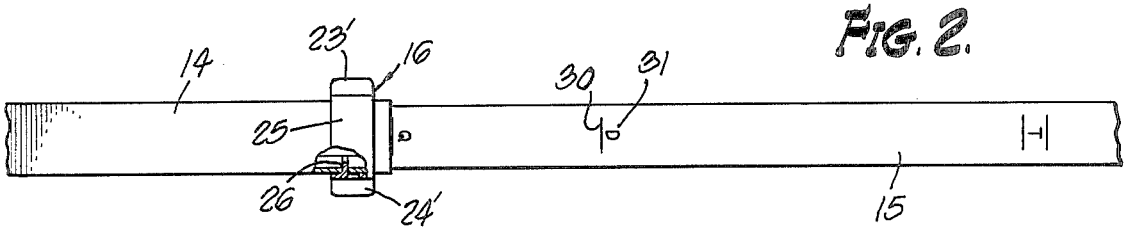
FIG. 2 is an enlarged fragmentary top plane view of two of the telescoped sections of the crossbar and an associated latch member, portions being cut away and sectioned to show details of the latching mechanism.

As shown in FIG. 2, the exposed upper surface of the intermediate section may be scribed or otherwise provided with indexing lines 30 and associated appropriate letter 31 for designating the adjusted positions of the sections to provide the desired bed width. For example, a "T" may be utilized for the twin size, a "D" for the double size and "Q" for gueen size.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extend indicated in the appended claims.

I claim:

1. A adjustable bedframe crossbar unit assembly adapted to be connected transversely between a pair of bedframe side rails, comprising:

a. a pair of axially aligned sections having adjacent ends in telescoped relation;

b. the innermost of said sections having an outwardly opening longitudinally extending side channel;

c. a plurality of slots extending from the bottom of said channel, said slots being spaced apart longitudinally of the channel;

d. an inverted U-shaped latch member straddling the adjacent end of the outermost of said sections, and being supported for selective guided manual movements between a lowered seated position and a raised position;

e. an inwardly extending projection on the leg portion of said latch member on the side adjacent said channel adapted in said raised position to be disposed in said channel so as to permit longitudinal telescopic adjustment of the sections, and in the lowered seated position to enter one of said slots to retain the sections against relative longitudinal movements.

2. A crossbar assembly as set forth in claim 1, in which said projection is guidingly moveable in a slot formed in an adjacent wall of the outermost of said sections.

3. A crossbar assembly as set forth in claim 2, wherein the top wall of said channel provides an abutment engageable by said projection in the raised position of said latch member.

4. A crossbar assembly as set forth in claim 1, including means for opposing endwise disconnection of said sections, which comprises an abutment in said channel, at the telescoped end of the innermost of said sections, adapted to engage said inwardly extending projection.

5. A crossbar assembly according to claim 4, in which a further abutment is positioned in said channel, in a non-telescoped portion of the innermost of said sections, for engaging said inwardly extending projection to limit axial movements of the sections towards each other.

6. A crossbar assembly as set forth in claim 1, in which means are respectively mounted at the outer end of each section for removably connecting such section to an associated side rail of the bed frame.

7. An adjustable bedframe crossbar unit assembly adapted to be connected transversely between a pair of bedframe side rails, comprising:

a. a pair of axially aligned end sections of transverse multisided configuration having outer ends adapted for connection with the respective side rails;

b. an intermediate section of transverse multisided configuration with its opposite ends slidably connected respectively in telescoped relation with the inner ends of said sections for relative axial adjustments and having opposite walls each formed with an outwardly opening longitudinally extending channel;

c. a plurality of pairs of parallel slots in said opposite walls extending from the bottoms of the channels, said pairs of slots being aligned transversely of and longitudinally spaced along said intermediate section;

d. manually releasable latch means for retaining said end sections and intermediate sections in selected axial positions of adjustment corresponding to different standard bed widths, including an inverted U-shaped latch member at the inner end of each of said end sections, having leg portions adapted to overlie the side walls of said end section, said latch member being supported for manual movement between a lowered seated position and a raised position; and e. inwardly extending tongues respectively on the leg portion of said latch member adapted in said raised position to be disposed in said channels so as to permit longitudinal telescopic adjustment between the end section and the intermediate section, and in the lowered seated position to enter a pair of said slots to restrain the end section and intermediate section against relative longitudinal movements.

8. A crossbar assembly as set forth in claim 7, wherein said tongues respectively extend through and are guidingly movable in an associated slot in the adjacent wall of the end section.

9. A crossbar assembly as set forth in claim 7, wherein enggement of said tongues with the tops of said channels serves to limit the movement of the latch member in said raised position and prevent disconnection of the latch member.

10. A crossbar assembly as set forth in claim 7, in which said tongues in the raised position of said latch member constitute abutment stops positioned in said channels for engagement by stops in said channel carried by and being movable with said intermediate member, whereby said sections are restrained against endwise disconnection.

* * * * *